US008472834B2

(12) United States Patent
Satoh

(10) Patent No.: US 8,472,834 B2
(45) Date of Patent: Jun. 25, 2013

(54) IMAGE FORMING APPARATUS

(75) Inventor: Toshiya Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 298 days.

(21) Appl. No.: 12/923,373

(22) Filed: Sep. 17, 2010

(65) Prior Publication Data

US 2011/0085821 A1 Apr. 14, 2011

(30) Foreign Application Priority Data

Oct. 13, 2009 (JP) ..... 2009-235935
May 31, 2010 (JP) ..... 2010-124370

(51) Int. Cl.
*G03G 15/00* (2006.01)

(52) U.S. Cl.
USPC ..... 399/90; 399/88; 399/113; 399/128

(58) Field of Classification Search
USPC ..... 399/113, 128, 88, 90
See application file for complete search history.

(56) References Cited

U.S. PATENT DOCUMENTS 4,708,455 A * 11/1987 Kubota et al. ..... 399/111
4,996,566 A * 2/1991 Morita et al. ..... 399/28
6,973,276 B2 * 12/2005 Mizoguchi ..... 399/90
7,209,676 B2 * 4/2007 Yokoi et al. ..... 399/90
2006/0045603 A1 * 3/2006 Hatori et al. ..... 400/693

FOREIGN PATENT DOCUMENTS

JP 3234839 9/2001

OTHER PUBLICATIONS

English language abstract of Japan Patent Publication No. JP 06-258957.

* cited by examiner

*Primary Examiner* — Walter L Lindsay, Jr.
*Assistant Examiner* — Benjamin Schmitt
(74) *Attorney, Agent, or Firm* — Harness, Dickey & Pierce P.L.C.

(57) ABSTRACT

An image forming apparatus includes an image carrier, a developing device that forms a toner image on the surface of the image carrier, a transfer unit that transfers the toner image formed on the image carrier onto a transfer material such as paper, a neutralizing unit that neutralizes an electrostatic latent image on the surface of the image carrier by light radiation, a cleaning unit that cleans toner remaining on the surface of the image carrier after the toner image is transferred. The image carrier, the developing device, the transfer unit, the neutralizing unit, and the cleaning unit are provided to the main body of the image forming apparatus. The image forming apparatus further includes a withdrawal mechanism that withdraws at least the image carrier, the cleaning unit, and the neutralizing unit integrally from the main body of the image forming apparatus.

17 Claims, 8 Drawing Sheets

IMAGE FORMING APPARATUS

CROSS-REFERENCE TO RELATED APPLICATIONS

The present application claims priority to and incorporates by reference the entire contents of Japanese Patent Application No. 2009-235935 filed in Japan on Oct. 13, 2009 and Japanese Patent Application No. 2010-124370 filed in Japan on May 31, 2010.

BACKGROUND OF THE INVENTION

1. Field of the Invention

The present invention relates to an image forming apparatus using an electrophotographic printing technology applicable to a facsimile, a printer, a copier, and a multifunction product having these functions, and particularly relates to an image forming apparatus including an optical neutralizing device positioned close to a photosensitive body and a cleaning unit.

2. Description of the Related Art

An image forming apparatus using an electrophotographic printing technology includes a charging unit, an exposure unit, a developing unit, a transfer unit, a neutralizing unit, a cleaning unit, and other units that are arranged around a photosensitive body as an image carrier. The surface of the photosensitive body is uniformly charged by corona discharge or the like, and is exposed to light corresponding to characters or the like to be printed to form an electrostatic latent image, and the image is developed with toner. Subsequently, the toner on the photosensitive body is transferred onto an intermediate transfer belt by bringing the intermediate transfer belt in contact with the toner image and by applying bias. The toner on the intermediate transfer belt is transferred onto the paper, and the toner image is fixed by heating, or heating and pressurizing the paper on which the toner is transferred to complete printing. After the completion of the transfer, the surface of the photosensitive body is cleaned and neutralized, and similar processes are further repeated.

As an image forming apparatus having the structure as described above, Japanese Patent No. 3234839 discloses a structure in which a neutralizing lamp (erasing lamp) is arranged at a position close to a photosensitive body and a cleaning unit. The neutralizing lamp is fixed on a bracket integrated with the image forming apparatus main body. The neutralizing lamp does not generally require maintenance substantially until the end of the service life of the main body. Therefore, typically, a neutralizing lamp is integrally installed in the image forming apparatus main body in such a structure that the neutralizing lamp cannot be inserted and removed as disclosed in Japanese Patent No. 3234839.

On the contrary, a photosensitive body, an intermediate transfer belt, and a cleaning unit that are positioned close to a neutralizing lamp require periodic maintenance and thus need to have a structure readily detachable from an image forming apparatus main body. However, the units may be, damaged by the contact with the neutralizing lamp, a sheet metal bracket fixing the neutralizing lamp, or the like during their insertion and removal because the neutralizing lamp is closely arranged. Accordingly, consideration is required to design a layout for preventing such breakage and for enabling units to be readily replaced. Specifically, in recent years, image forming apparatuses are designed to have a layout in which components are arranged extremely close to each other in the main body in order to save space. However, for easy replacement, the layout is required to have a structure with which general users can replace the components without any particular concern.

SUMMARY OF THE INVENTION

It is an object of the present invention to at least partially solve the problems in the conventional technology.

According to one aspect of the present invention, an image forming apparatus includes an image carrier, a developing device that forms a toner image on the surface of the image carrier, a transfer unit that transfers the toner image formed on the image carrier onto a transfer material such as paper, a neutralizing unit that neutralizes an electrostatic latent image on the surface of the image carrier by light radiation, a cleaning unit that cleans toner remaining on the surface of the image carrier after the toner image is transferred. The image carrier, the developing device, the transfer unit, the neutralizing unit, and the cleaning unit are provided to the main body of the image forming apparatus. The image forming apparatus further includes a withdrawal mechanism that withdraws at least the image carrier, the cleaning unit, and the neutralizing unit integrally from the main body of the image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An image forming apparatus of the present invention has a withdrawal mechanism in which at least an image carrier, a cleaning unit, and a neutralizing unit can be integrally withdrawn from the main body of the image forming apparatus (hereinafter "image forming apparatus main body"). The neutralizing unit remains in the withdrawal mechanism during the replacement of the image carrier and the cleaning unit, and thus, each unit can be independently replaced. The withdrawal mechanism is also withdrawn integrally with a developing device, and wiring is arranged so that electricity is supplied to the neutralizing unit by being connected to the drawer connector of the developing device.

Specifically, the photosensitive body and the cleaning unit are arranged close to the neutralizing lamp such that the photosensitive body (image carrier) and the cleaning unit that are replaced periodically are prevented from interfering with and being damaged by the neutralizing lamp (neutralizing unit) during replacement. Moreover, the neutralizing unit remains in the withdrawal mechanism during the replacement of the photosensitive body and the cleaning unit, and therefore, units related to image formation can be replaced without replacing the neutralizing lamp that has a long service life and is expensive.

The developing device is integrally withdrawn with the withdrawal mechanism, and a harness is routed to connect the neutralizing lamp with the drawer connector of the developing device so that electricity is supplied to the neutralizing lamp. As a result, an additional connecting component for supplying electricity to the neutralizing lamp is not required.

Exemplary embodiments according to the present invention are described below with reference to the accompanying drawings.

Figure 1:
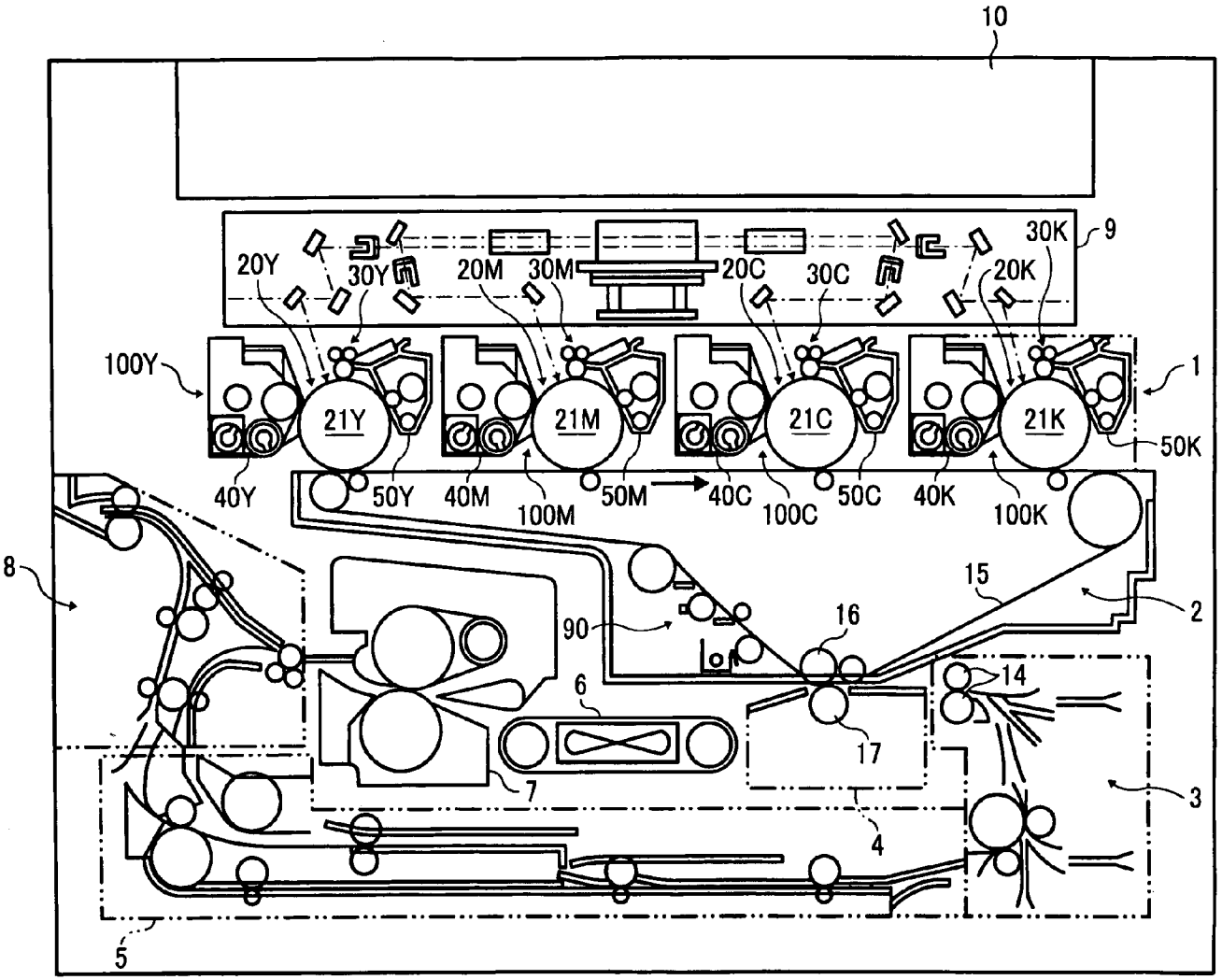
FIG. 1 is a schematic diagram of an example of an image forming apparatus according to an embodiment of the present invention.

The structure and the operation of an image forming apparatus according to an embodiment of the present invention are described. FIG. 1 is a schematic diagram of an example of the image forming apparatus according to the embodiment. Although detailed illustration is omitted, the image forming apparatus includes an image forming unit 1 in which four process cartridge unit (PCU) frames 100Y, 100M, 100C, and 100K are arranged in tandem.

The PCU frames 100Y, 100M, 100C, and 100K support photosensitive modules 20Y, 20M, 20C, and 20K as latent image carrier modules including cylindrical-shaped photosensitive bodies 21Y, 21M, 21C, and 21K as latent image carriers, charging modules 30Y, 30M, 30C, and 30K including charging devices, two-component development type developing devices 40Y, 40M, 40C, and 40K, cleaning modules 50Y, 50M, 50C, and 50K including drum cleaning devices, respectively, by respective common unit frames. These PCU frames 100Y, 100M, 100C, and 100K are individually detachable from the image forming apparatus main body.

An exposure unit 9 is provided as a latent image forming unit above the image forming unit 1. A reading device 10 that scans and reads an original placed on a contact glass is provided at the upper portion of the image forming apparatus. A transfer unit 2 including an intermediate transfer belt 15 as an intermediate transfer body that is a transfer object is provided below the image forming unit 1. The intermediate transfer belt 15 is looped over a plurality of support rollers and endlessly moves in a clockwise direction as viewed in FIG. 1. A secondary transfer device 4 is provided below the transfer unit 2. The secondary transfer device 4 includes a secondary transfer roller 17. The secondary transfer roller 17 comes in contact with the front surface of the intermediate transfer belt 15 at a portion looped around a transfer counter roller 16 to form a secondary transfer nip. Secondary transfer bias is applied on the secondary transfer roller 17 by a power source (not illustrated). The transfer counter roller 16 is electrically grounded. Accordingly, secondary transfer electric field is formed in the secondary transfer nip. A fixing unit 7 that includes a heating roller having a heater therein is provided on the left of the secondary transfer device 4 as viewed in FIG. 1 in order to fix a toner image transferred on paper. A conveying belt 6 that conveys paper on which a toner image is transferred to the fixing unit 7 is provided at a position between the secondary transfer device 4 and the fixing unit 7. A feeding unit 3 that feeds paper one by one separately fed from a paper feed storage unit (not illustrated) to the secondary transfer device 4 is provided at the bottom of the image forming apparatus. A discharging unit 8 conveys paper having passed through the fixing unit 7 to the exterior of the image forming apparatus or to a double-sided unit 5.

For making a copy by the image forming apparatus, the reading device 10 reads an original. The intermediate transfer belt 15 moves in a clockwise direction as viewed in FIG. 1 concurrently with the reading of the original. At the same time, in the image forming unit 1, the surface of each of the photosensitive bodies 21Y, 21M, 21C, and 21K that is uniformly charged at a predetermined charge potential by the charging device in each of the charging modules 30Y, 30M, 30C, and 30K is exposed to light by the exposure unit 9. The exposure is performed using color information of yellow, magenta, cyan, and black based on the content of the original read out, thereby forming a latent image. The latent image on each of the photosensitive bodies 21Y, 21M, 21C, and 21K is developed by the developing devices 40Y, 40M, 40C, and 40K to form a monochromatic toner image. The toner images on the photosensitive bodies 21Y, 21M, 21C, and 21K are sequentially transferred onto the intermediate transfer belt 15 so as to be superimposed on each other to form a combined toner image on the intermediate transfer belt 15.

After the toner images are transferred, the drum cleaning devices in the cleaning modules 50Y, 50M, 50C, and 50K remove toner remaining on the photosensitive bodies 21Y, 21M, 21C, and 21K, and the photosensitive bodies 21Y, 21M, 21C, and 21K are ready for further image formation.

While the toner images are formed, paper is taken out from the paper feed storage unit (not illustrated) one by one and abuts a pair of resist rollers 14 to be stopped. The pair of resist rollers 14 rotates to feed paper in the secondary transfer nip when the combined toner image on the intermediate transfer belt 15 reaches the secondary transfer nip, and the combined toner image is transferred on the paper by the secondary transfer device 4. The paper on which the toner image is transferred is conveyed by the conveying belt 6 and is fed into the fixing unit 7. The fixing unit 7 fixes the toner image by applying heat and pressure and then feeds the resultant paper into the discharging unit 8.

The discharging unit 8 guides the paper onto a discharge tray (not illustrated) at the exterior of the image forming apparatus (on the left of the image forming apparatus as viewed in FIG. 1) or into the double-sided unit 5 at the bottom of the image forming apparatus using a switching claw. The double-sided unit 5 reverses the paper and guides it into the secondary transfer nip again. After an image is recorded also on the back surface of the paper, the discharging unit 8 discharges the resultant paper onto the discharge tray. After the image is transferred, an intermediate transfer belt cleaning unit 90 removes toner remaining on the intermediate transfer belt 15, and the intermediate transfer belt 15 is ready for further image formation.

The four PCU frames 100Y, 100M, 100C, and 100K are described below in detail. The four PCU frames 100Y, 100M, 100C, and 100K have substantially the same structure except that the color of toner employed by each PCU frame is different. Accordingly, Y, M, C, and K that are reference characters for identifying colors are omitted in the description below, and one exemplary PCU frame 100 will be described.

Figure 2:
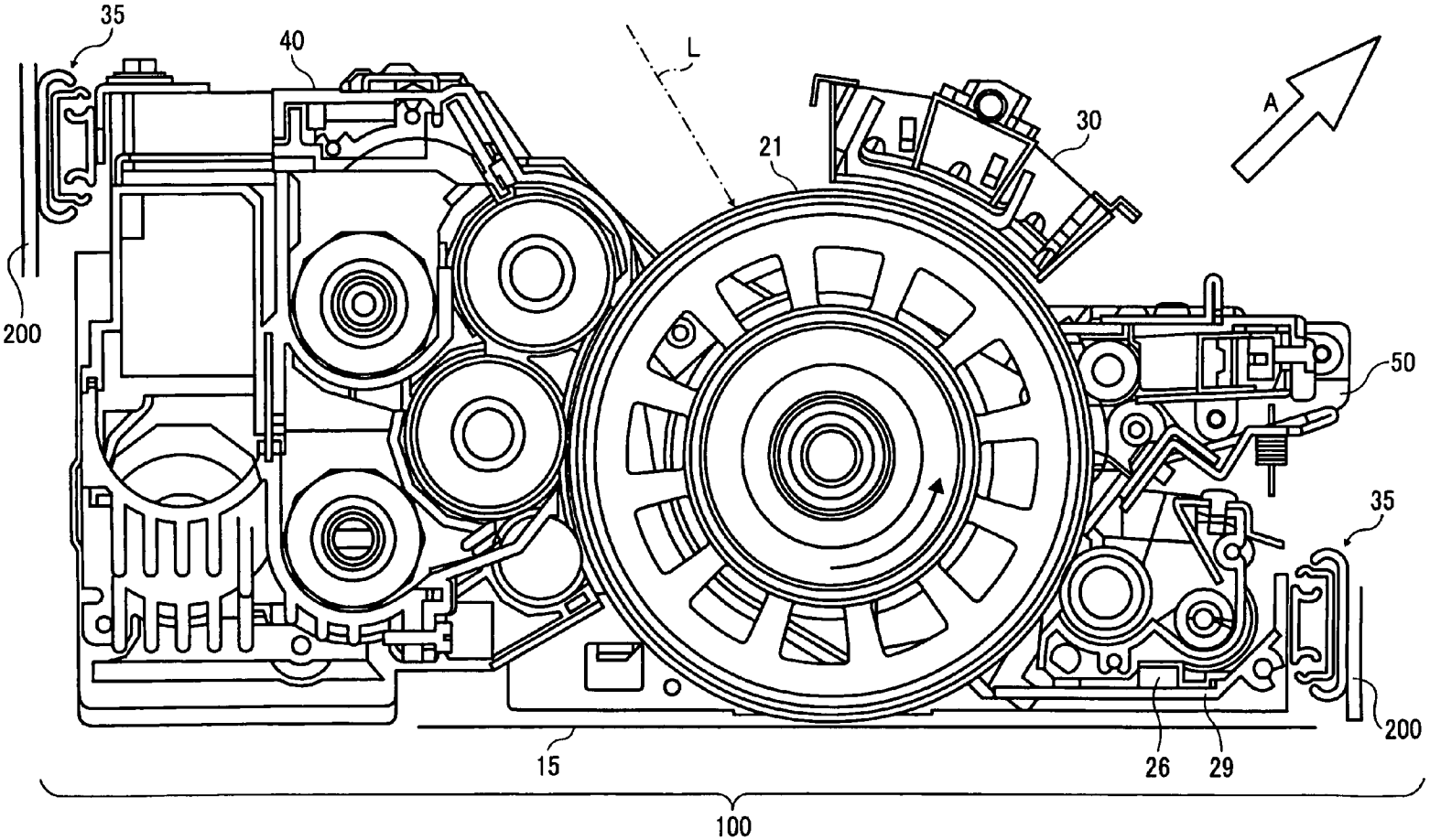
FIG. 2 is a cross-sectional schematic diagram of a process cartridge unit (PCU) frame of the apparatus illustrated in FIG. 1.

FIG. 2 is a cross-sectional schematic diagram of the PCU frame 100. In this example, a photosensitive body 21 rotates in a direction of an arrow in FIG. 2 and is uniformly charged by corona discharge using a charging module 30. The uniformly charged photosensitive body 21 is irradiated with laser light L corresponding to an image to be printed by exposure to light radiated, from a writing device (not illustrated), thereby forming an electrostatic latent image on the photosensitive body 21. A developing device 40 develops the electrostatic latent image with toner. The toner image on the photosensitive body 21 is transferred onto the intermediate transfer belt 15 and then is transferred onto paper at the secondary transfer nip. After such transferring process, a neutralizing lamp 26 irradiates the surface of the photosensitive body 21 with light to remove electrostatic potential remaining thereon and resets the potential (neutralization of the electrostatic latent image). Subsequently, a cleaning module 50 as a cleaning unit removes toner remaining on the surface of the photosensitive body 21.

In the embodiment of the present invention, the developing device 40 and the PCU frame 100 are integrated, and the neutralizing lamp 26 is fixed at a stay 29 that is one part of the integrated PCU frame 100. The photosensitive body 21 and the cleaning module 50 are installed on the PCU frame 100.

The neutralizing lamp 26 and the stay 29 for fixing the neutralizing lamp 26 are arranged to have a positional relationship in which they are positioned extremely close to the cleaning module 50 and the intermediate transfer belt 15 with a gap of, for example, 0.5 millimeter to 4 millimeters, due to restriction for saving space. The PCU frame 100 can be withdrawn using a rail 35 attached to the frame from the image forming apparatus main body (in FIG. 2, a component like a side plate indicated with a reference numeral 200 represents the image forming apparatus main body; hereinafter the image forming apparatus main body is indicated by 200).

Figure 3:
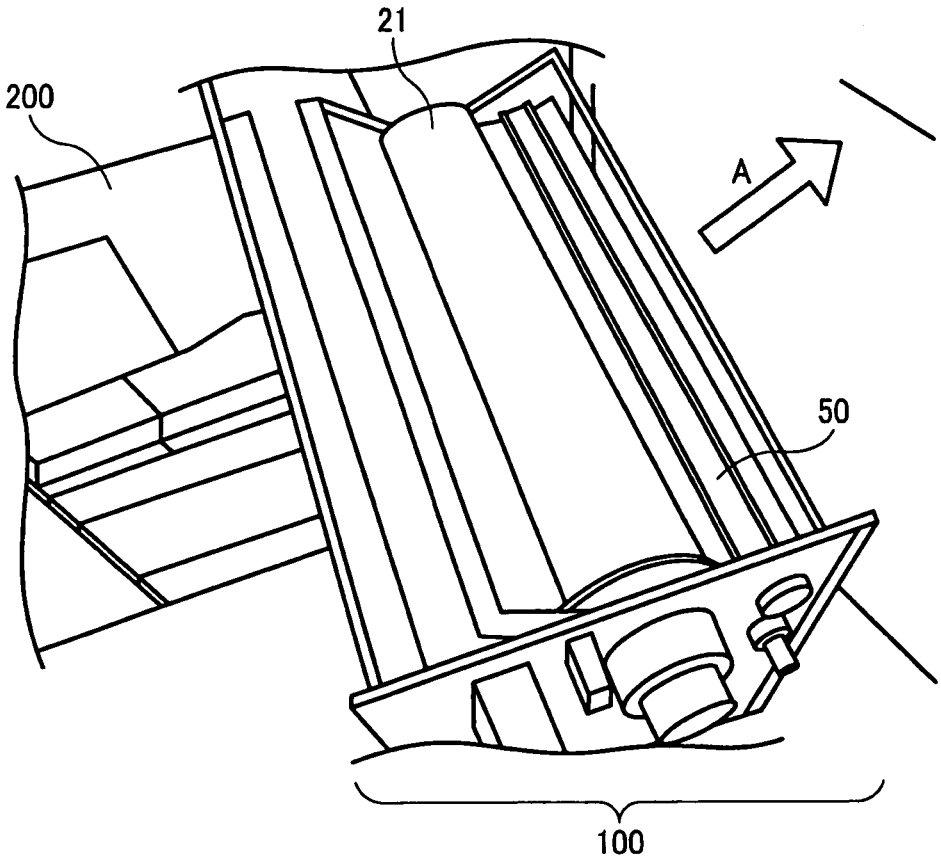
FIG. 3 is a schematic diagram illustrating a state where the PCU frame is withdrawn from an image forming apparatus main body.

FIG. 3 illustrates a state where the PCU frame 100 is withdrawn from the image forming apparatus main body 200 in a horizontal direction. Each of the photosensitive body 21 and the cleaning module 50 is detachable from the PCU frame 100 withdrawn from the image forming apparatus main body 200.

In the embodiment of the present invention, for withdrawing the PCU frame 100 from the image forming apparatus main body 200 in a horizontal direction, an operator opens an opening and closing door (not illustrated) in the exterior wall of the image forming apparatus main body 200. The opening and closing door is arranged at a position facing the head end surface (front surface) of the PCU frame 100. The front surface is positioned at the head (hereinafter, "front") of the PCU frame 100 when the PCU frame 100 is slid from a set position where the PCU frame 100 is set inside of the image forming apparatus main body 200 to a replacement position where the photosensitive body 21 and the cleaning module 50 that are supported by the PCU frame 100 are replaceable.

Figure 4:
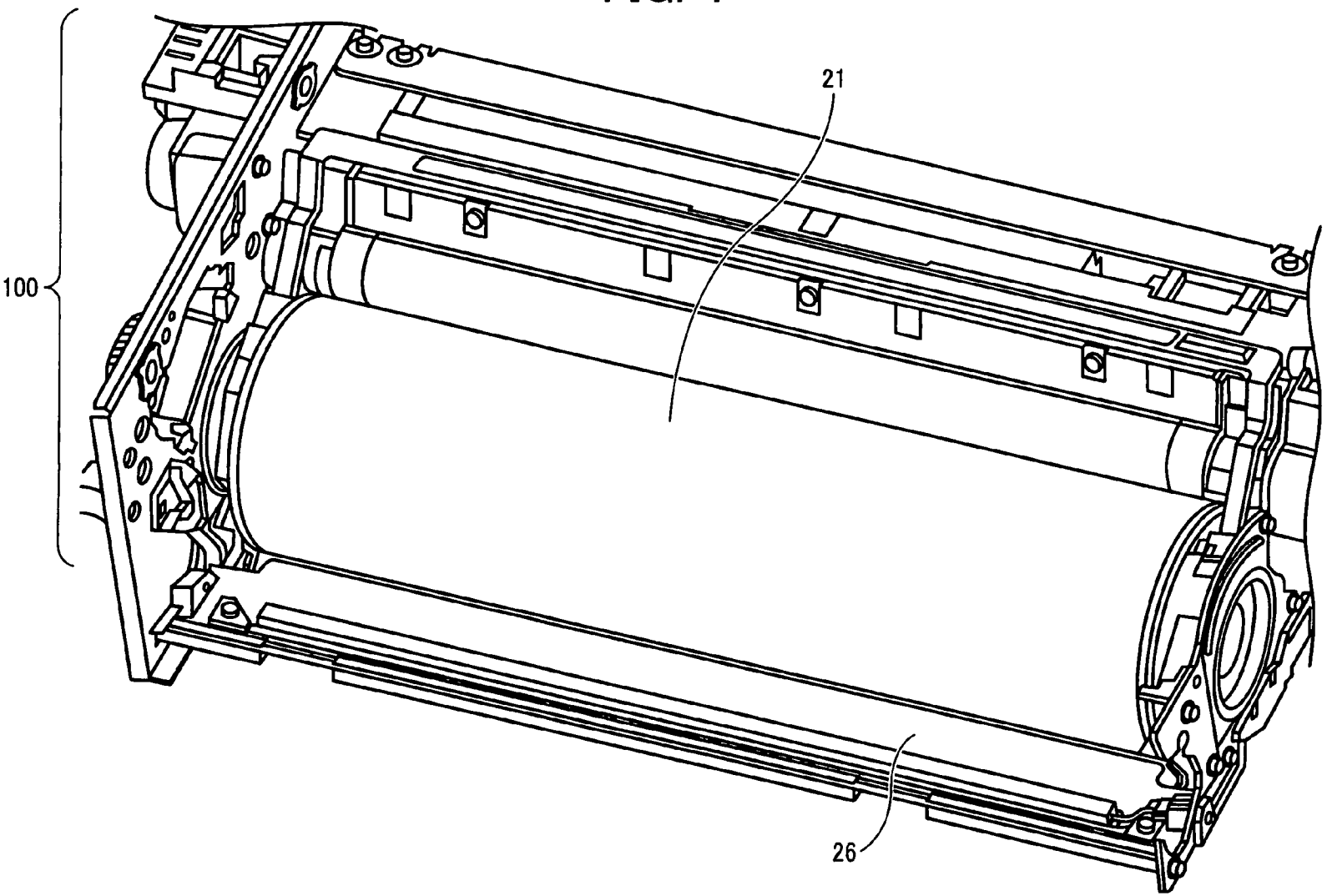
FIG. 4 is a schematic diagram illustrating a state where the PCU frame is withdrawn from the image forming apparatus main body and is slid to a replacement position.

Subsequently, an operator who has opened the opening and closing door withdraws the PCU frame 100 to the front. Accordingly, the PCU frame 100 can be slid to the replacement position as illustrated in FIG. 3. In the embodiment of the present invention, two rails 35 are provided as unit supporting units that support the PCU frame 100. The two rails 35 are attached at both side portions of the PCU frame 100 in a sliding direction and maintain the PCU frame 100 at the replacement position without dropping the PCU frame 100 even in a state where the PCU frame 100 slides to the replacement position illustrated in FIG. 4. According to the embodiment of the present invention, the photosensitive body 21 and the cleaning module 50 of the PCU frame 100 can be replaced while the PCU frame 100 is in a state of being withdrawn at the replacement position.

In the embodiment of the present invention, the opening and closing door is the only member that inhibits the pathway of the PCU frame 100 sliding from the set position to the replacement position. While being in an opened state, the opening and closing door is positioned out of the pathway. Accordingly, once an operator opens the opening and closing door, he/she can withdraw the PCU frame 100 without removing the other components from the pathway.

Figure 5:
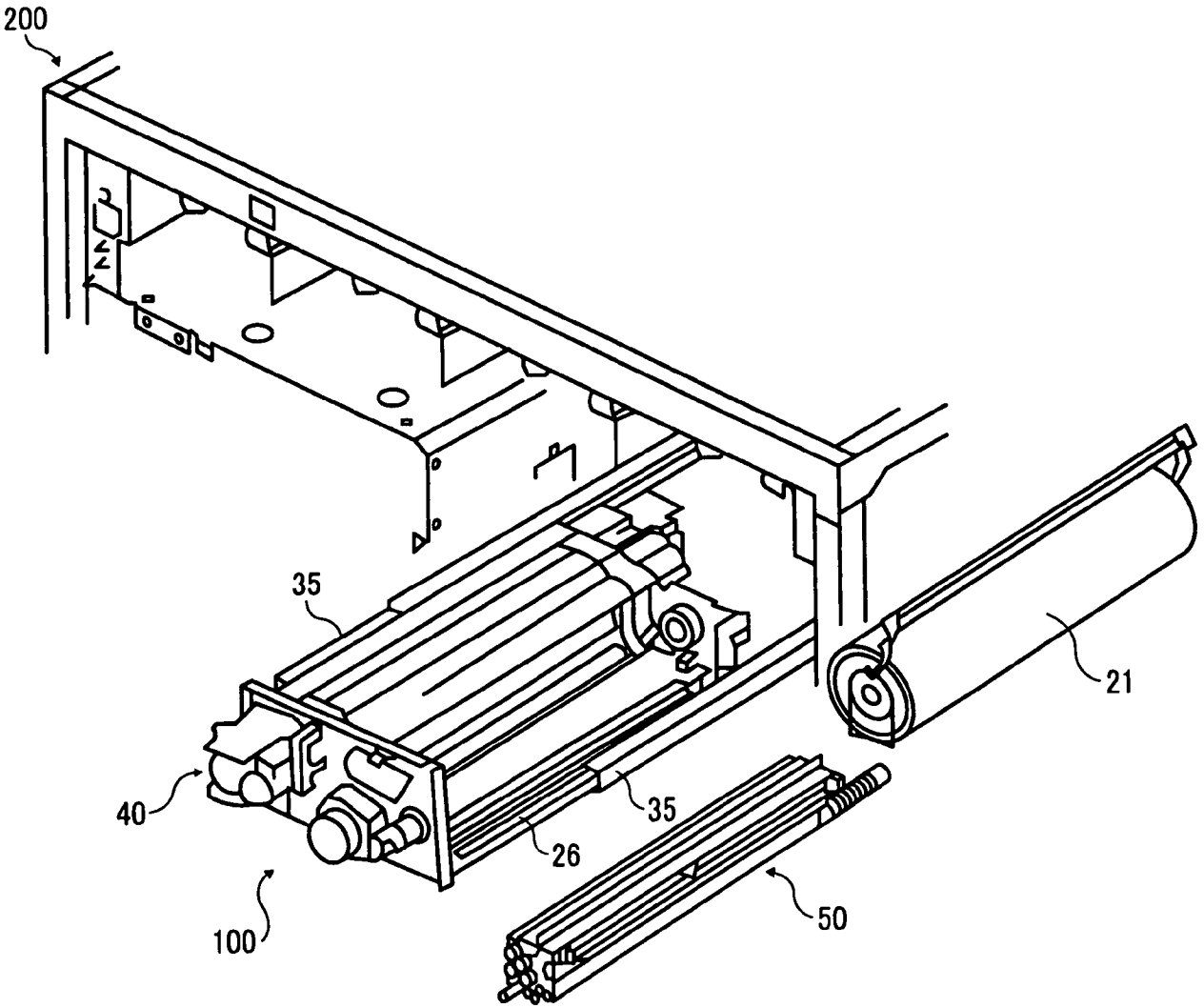
FIG. 5 is a schematic diagram illustrating a state where a cleaning module is removed, and a neutralizing lamp remains in the PCU frame.

FIG. 5 is a schematic diagram illustrating a state where the cleaning module 50 is removed, and the neutralizing lamp 26 remains in the PCU frame 100. The detaching direction is all in an arrow A direction of FIG. 3 that is a direction apart from the neutralizing lamp 26. Therefore, although the photosensitive body 21, the cleaning module 50, and the neutralizing lamp 26 are arranged so as to be close to each other, the photosensitive body 21 or other units are in no danger of breakage by the interference from the neutralizing lamp 26 while being replaced.

Figure 6:
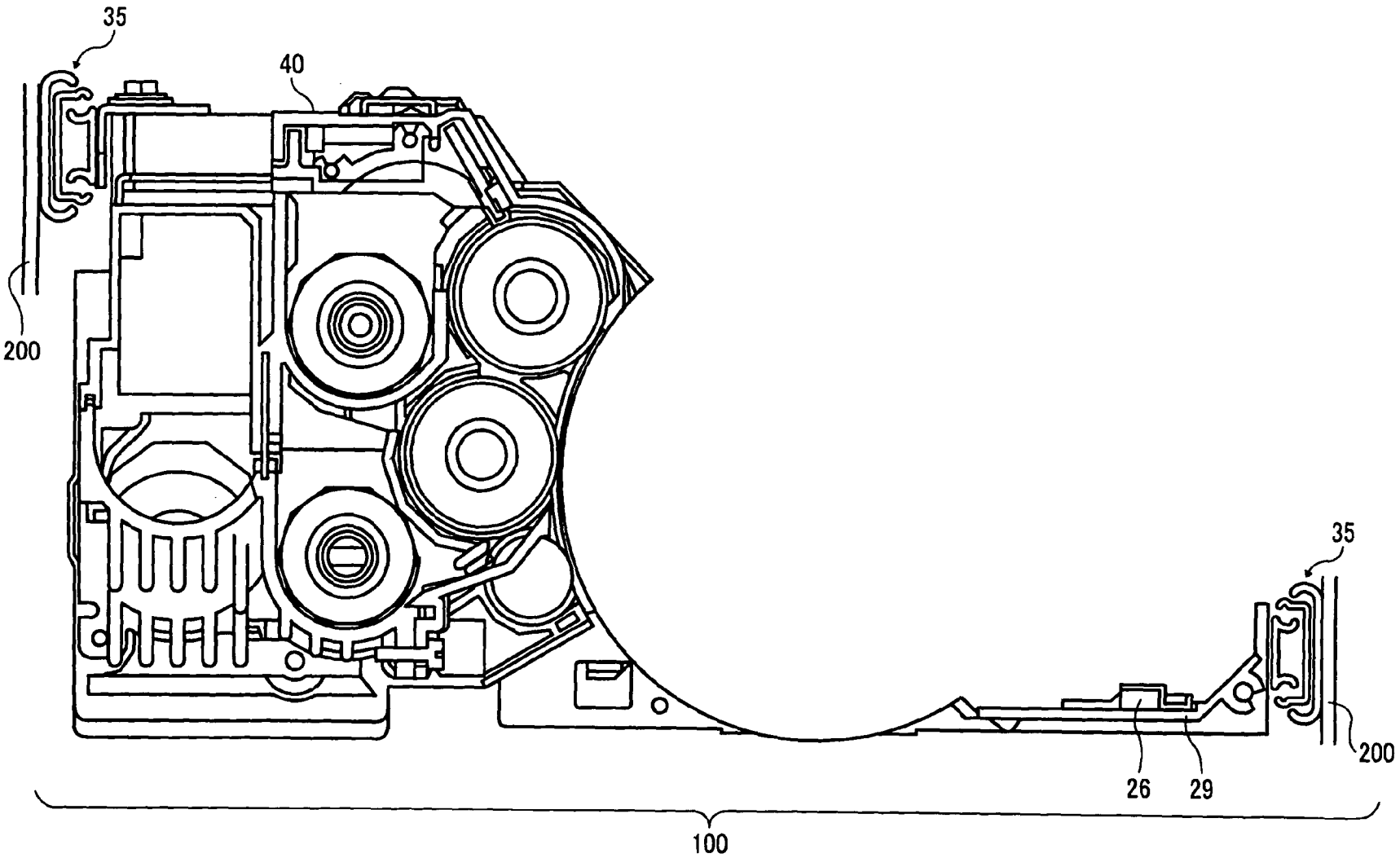
FIG. 6 is a cross-sectional schematic view of the PCU frame in a state where a cleaning module and a photosensitive body that are illustrated in FIG. 1 are removed.
Figure 7:
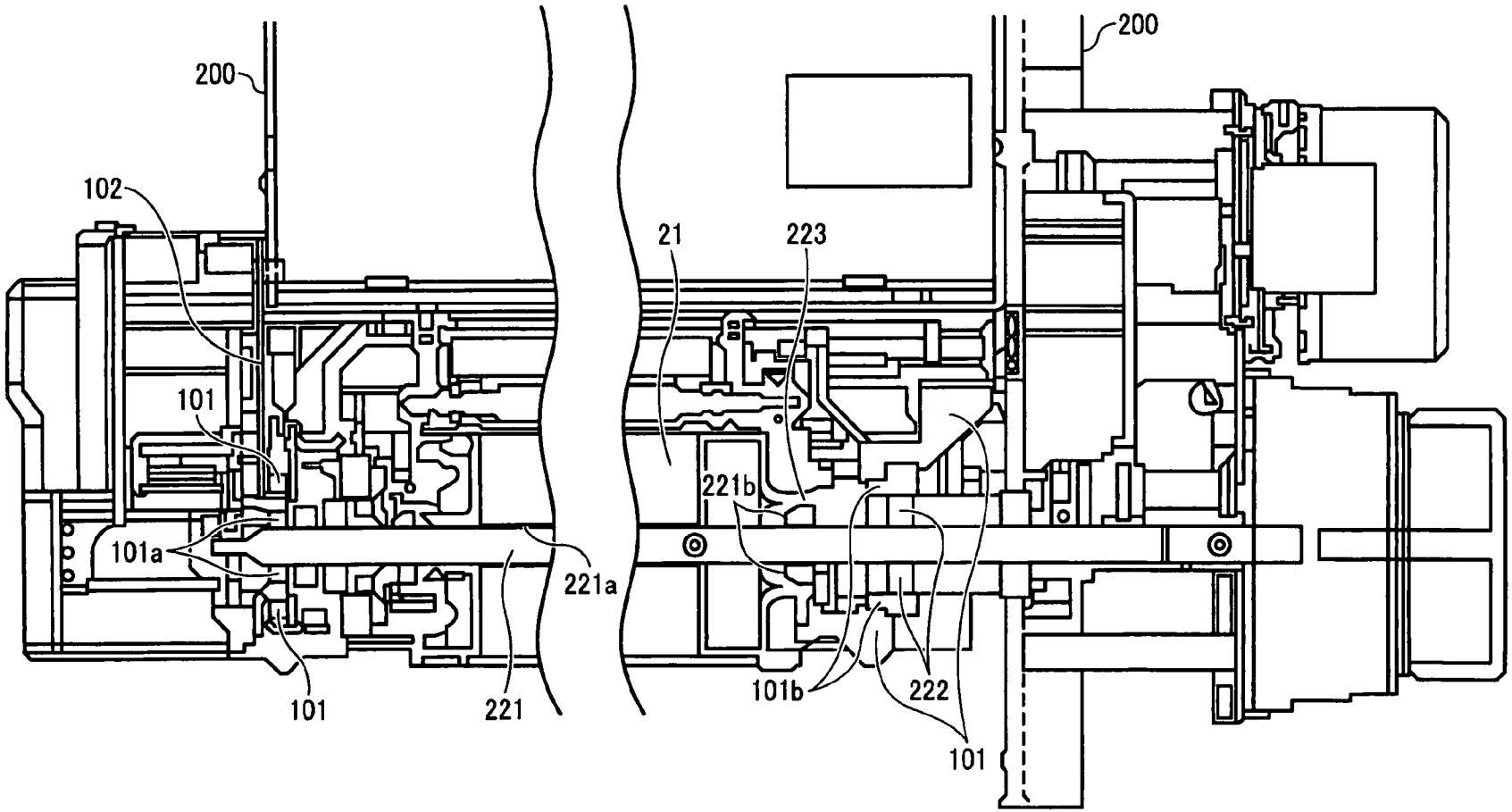
FIG. 7 is a cross-sectional schematic diagram of the PCU frame along a direction of a shaft for a photosensitive body in a state where the PCU frame is set in the set position.

The positioning structure of devices mounted on the PCU frame 100 is described below. FIG. 6 is a cross-sectional view of the PCU frame 100 in a state where the cleaning module 50 and the photosensitive body 21 are removed. FIG. 7 is a cross-sectional schematic diagram of the PCU frame 100 set in the set position along a direction of the shaft of the photosensitive body.

In the embodiment of the present invention, the cleaning module 50, the photosensitive body 21, and the other devices (such as the developing device 40), all of which are mounted on the PCU frame 100, are integrally supported by a common unit frame 101 of the PCU frame 100. A front plate 102 made of metal is attached to the front of the common unit frame 101 and enhances the strength and positioning accuracy of the front portion of the common unit frame 101. When the PCU frame 100 is set at the set position, the strength and positioning accuracy of the rear portion of the common unit frame 101 are enhanced by connecting portions of various driving systems provided at the rear portion of the PCU frame 100 with connected portions that are provided at the image forming apparatus main body at a plurality of positions.

In other words, the cleaning module 50 and the photosensitive body 21 on the PCU frame 100 are detachable from the unit frame 101 and each positioned with respect to the common unit frame 101. As a result, a relative positional relationship between each of the devices on the PCU frame 100 can be determined with high accuracy by producing the common unit frame 101 with high dimensional accuracy.

When the PCU frame 100 is at the set position, the unit frame 101 of the PCU frame 100 is positioned against the image forming apparatus main body 200 by a photosensitive body driving shaft 221 provided on the image forming apparatus main body 200 and a bearing 222 thereof. Specifically, an insertion hole 221*a*, into which the photosensitive body driving shaft 221 provided on the image forming apparatus main body 200 is inserted, is formed in the photosensitive body 21 of a photosensitive module 20. As illustrated in FIG. 7, when the photosensitive body driving shaft 221 is fully inserted into the insertion hole 221*a*, a photosensitive body driving joint 223 of the photosensitive body driving shaft 221 is connected with a joint portion 221*b* provided at the insertion hole 221*a* of the photosensitive body 21, and the photosensitive body 21 becomes rotatable together with the photosensitive body driving shaft 221. Moreover, when the photosensitive body driving shaft 221 is fully inserted into the insertion hole 221*a* of the photosensitive body 21, the front end portion of the photosensitive body driving shaft 221 fits a front fitting portion 101*a* provided at the front portion of the unit frame 101, and the bearing 222 provided on the photosensitive body driving shaft 221 fits a rear fitting portion 101*b* provided at the rear portion of the unit frame 101. Accordingly, the unit frame 101 of the PCU frame 100 is positioned at two portions of the front and the rear thereof with respect to the photosensitive body driving shaft 221 provided on the image forming apparatus main body. In other words, in the positioning structure in the embodiment of the present invention, the photosensitive body 21 on the PCU frame 100 is positioned directly with the photosensitive body driving shaft 221 provided to the image forming apparatus main body 200, and therefore, high positional accuracy with respect to the image forming apparatus main body 200 can be obtained.

The neutralizing lamp 26 is attached to the PCU frame 100 using a neutralizing lamp holder, and the neutralizing lamp holder is provided so as to cover over the neutralizing lamp 26. With this structure, even when toner adhering to the cleaning module 50 and the photosensitive body 21 falls off while the cleaning module 50 and the photosensitive body 21 are replaced on the PCU frame 100, the neutralizing lamp 26 positioned below the neutralizing lamp holder can be inhibited from direct adherence of the toner. While a unit such as the photosensitive body 21 is replaced, the neutralizing lamp 26 remains attached to the PCU frame 100 and thus is not replaced together with other replaced units. This can prevent an increase in cost derived from unnecessary replacement.

Figure 8:
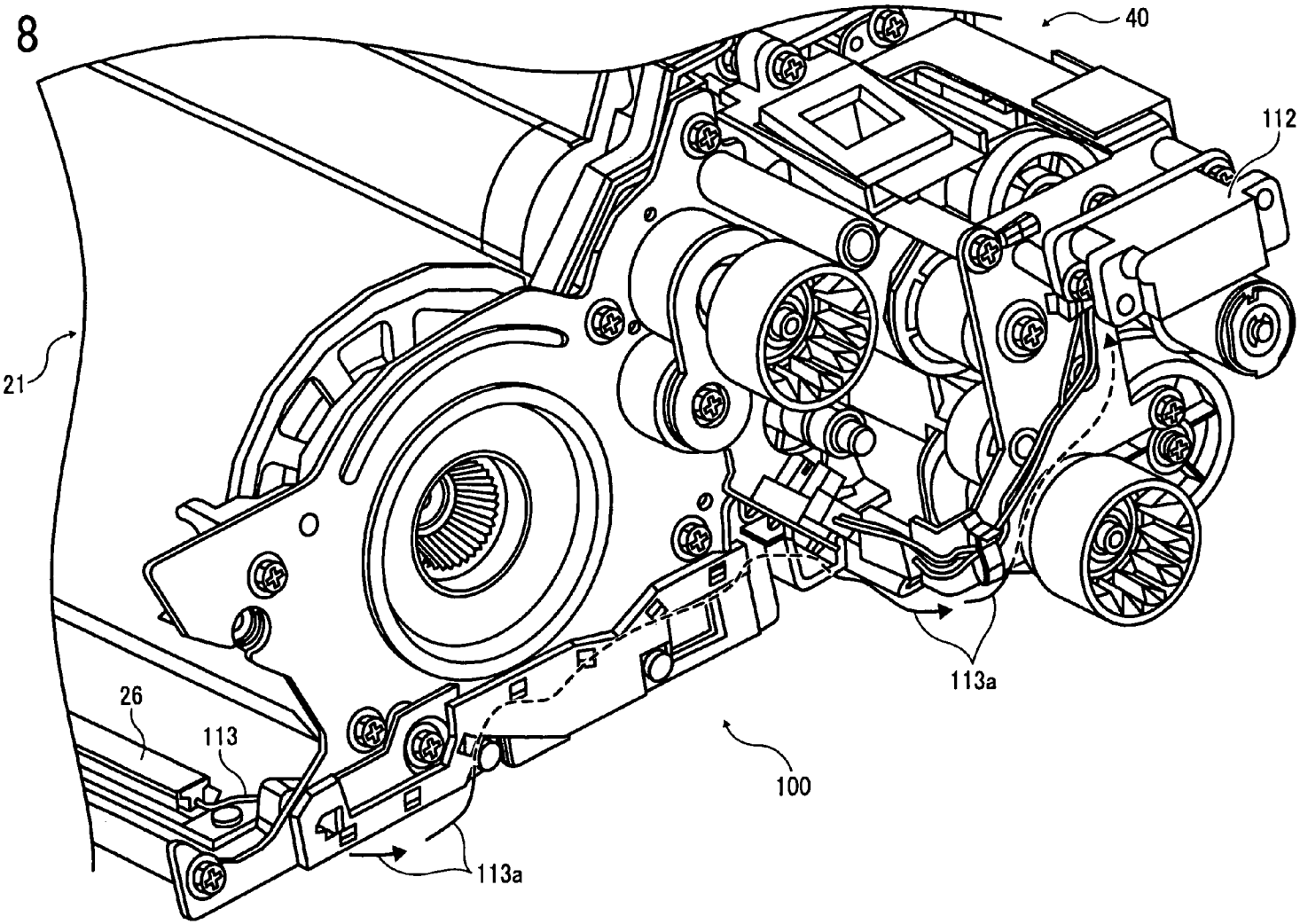
FIG. 8 is a schematic diagram illustrating an electricity supply path from the image forming apparatus main body to the neutralizing lamp.

An electricity supply path from the image forming apparatus main body 200 to the neutralizing lamp 26 is described with reference to FIG. 8. A drawer connector 112 for supplying electricity is provided at the developing device 40 integral with the PCU frame 100. The drawer connector 112 enables an electricity supply unit (power supply unit (PSU)) (not illustrated) provided at the image forming apparatus main body 200 to supply electricity to electrical components attached to the PCU frame 100 and to disconnect the electricity path. Electricity is supplied to electrical components such as a toner concentration sensor (T sensor) (not illustrated) attached to the developing device 40 via the drawer connector 112.

In this example, the neutralizing lamp 26 installed in the PCU frame 100 is also connected to the drawer connector 112 via a harness 113 routed (the routed portion is indicated by a line with an arrow and with a reference numeral 113*a*) to allow electricity to be supplied from the image forming apparatus main body 200. With such a structure, additional components for electrically connecting or disconnecting the image forming apparatus main body 200 with or from the PCU frame 100 are not required, and therefore, the neutralizing lamp 26 can be installed in the PCU frame 100 with a simple structure.

In the image forming apparatus of the embodiment of the present invention, a neutralizing unit (such as a lamp) can be arranged close to an image carrier and a cleaning unit that require periodical replacement, while the interference from or the breakage by the neutralizing unit during the replacement of the image carrier, the cleaning unit, and other units can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier;

a developing device that forms a toner image on the surface of the image carrier;

a transfer unit that transfers the toner image formed on the image carrier onto a transfer material such as paper;

a neutralizing unit that neutralizes an electrostatic latent image on the surface of the image carrier by light radiation;

a cleaning unit that cleans toner remaining on the surface of the image carrier after the toner image is transferred, the image carrier, the developing device, the transfer unit, the neutralizing unit, and the cleaning unit being provided in the main body of the image forming apparatus;

a process cartridge unit frame supporting the image carrier, the developing device, the neutralizing unit, and the cleaning unit;

a withdrawal mechanism that withdraws at least the image carrier, the cleaning unit, and the neutralizing unit integrally from the main body of the image forming apparatus, the withdrawal mechanism including rails attached to at least both side portions of the process cartridge unit frame so as to slide the process cartridge unit frame to a replacement position; and wiring through which electricity is supplied to the neutralizing unit by a drawer connector provided at the developing device, wherein:

the withdrawal mechanism is withdrawn from the main body of the image forming apparatus together with the developing device, and the drawer connector is connected with the neutralizing unit to supply electricity to the neutralizing unit when the developing device is inserted into the main body of the image forming apparatus together with the withdrawal mechanism.

2. The image forming apparatus according to claim 1, wherein the neutralizing unit remains in the withdrawal mechanism while the image carrier and the cleaning unit are replaced.

3. The image forming apparatus according to claim 1, wherein the neutralizing unit is arranged close to the image carrier and the cleaning unit.

4. The image forming apparatus according to claim 1, wherein the neutralizing unit is arranged so as not to lie in a replacing direction of the image carrier and the cleaning unit in the withdrawal mechanism.

5. The image forming apparatus according to claim 1, wherein the image forming apparatus is a facsimile, a printer, a copier, or a multifunction product having functions of a facsimile, a printer, and a copier, all of which operate using an electrophotographic printing technology.

6. The image forming apparatus according to claim 1, wherein the neutralizing unit is positioned close to the cleaning unit and an intermediate transfer device.

7. The image forming apparatus according to claim 6, wherein the neutralizing unit is positioned next to the cleaning unit and the intermediate transfer device with a distance between the neutralizing unit and cleaning unit of 0.5 millimeter to 4 millimeter.

8. The image forming apparatus according to claim 1, wherein the process cartridge unit frame is slid from a set position where the process cartridge unit frame is set inside of the image forming apparatus to the replacement position where the image carrier and the cleaning unit that are supported by the process cartridge unit frame are replaceable.

9. The image forming apparatus according to claim 1, wherein the rails maintain the process cartridge unit frame at the replacement position without dropping the process cartridge unit frame even in a state where the process cartridge unit frame slides to the replacement position.

10. The image forming apparatus according to claim 1, wherein the process cartridge unit frame further comprises a common unit frame to support the cleaning unit, the image carrier, and the developing device.

11. The image forming apparatus according to claim 10, wherein a front plate is attached to a front of the common unit frame to enhance the strength and position accuracy of the common unit frame.

12. The image forming apparatus according to claim 10, wherein when the process cartridge unit frame is at a set position, the common unit frame of the process cartridge unit frame is positioned against the image forming apparatus via a driving shaft provided on a main body of the image forming apparatus and a bearing thereof.

13. The image forming apparatus according to claim 12, wherein the common unit frame is positioned at two portions of a front and a rear thereof with respect to the driving shaft provided on the main body of the image forming apparatus.

14. The image forming apparatus according to claim 1, wherein the developing device includes a drawer connector for supplying electricity.

15. The image forming apparatus according to claim 14, wherein the drawer connector enables an electricity supply unit to supply electricity to electrical components attached to the process cartridge unit frame and disenable electricity to the electrical components.

16. The image forming apparatus according to claim 14, wherein the neutralizing unit includes a neutralizing lamp, the neutralizing lamp is connected to the drawer connector via a harness.

17. An image forming apparatus, comprising:

an image carrier;

a developing device that forms a toner image on the surface of the image carrier;

a transfer unit that transfers the toner image formed on the image carrier onto a transfer material such as paper;

a neutralizing unit that neutralizes an electrostatic latent image on the surface of the image carrier by light radiation;

a cleaning unit that cleans toner remaining on the surface of the image carrier after the toner image is transferred, the image carrier, the developing device, the transfer unit, the neutralizing unit, and the cleaning unit being provided in the main body of the image forming apparatus;

a process cartridge unit frame supporting the image carrier, the developing device, the neutralizing unit, and the cleaning unit; and a withdrawal mechanism that withdraws at least the image carrier, the cleaning unit, and the neutralizing unit integrally from the main body of the image forming apparatus, the withdrawal mechanism including rails attached to at least both side portions of the process cartridge unit frame so as to slide the process cartridge unit frame to a replacement position, wherein the developing device includes a drawer connector for supplying electricity, and wherein the neutralizing unit includes a neutralizing lamp, the neutralizing lamp is connected to the drawer connector via a harness.

* * * * *